United States Patent [19]

Schille

[11] Patent Number: 4,984,499

[45] Date of Patent: Jan. 15, 1991

[54] ELECTRONIC HARMONICA FOR CONTROLLING SOUND SYNTHESIZERS

[76] Inventor: Ron Schille, 701 Mills Ave., Apt. 3, San Bruno, Calif. 94066

[21] Appl. No.: 319,577

[22] Filed: Mar. 6, 1989

[51] Int. Cl.[5] ..... G10H 5/00

[52] U.S. Cl. ..... 84/734; 84/377; 84/DIG. 14

[58] Field of Search ..... 84/377, 378, 672, 723–742, 84/DIG. 14

[56] References Cited

U.S. PATENT DOCUMENTS

| | | | |
|---|---|---|---|
| 2,565,100 | 8/1951 | Tate | 84/DIG. 14 |
| 2,772,593 | 12/1956 | Zielinski | 84/DIG. 14 |
| 2,945,408 | 7/1960 | Terlinde | 84/DIG. 14 |
| 3,322,875 | 5/1967 | Roll et al. | 84/DIG. 14 |
| 3,516,320 | 6/1970 | Hillairet et al. | 84/672 |
| 3,684,814 | 8/1972 | Neustadt | 84/734 |
| 4,385,541 | 5/1983 | Müller et al. | 84/377 X |
| 4,566,363 | 1/1986 | Arai | 84/DIG. 14 |
| 4,619,175 | 10/1986 | Matsuzaki | 84/DIG. 14 |

*Primary Examiner*—Stanley J. Witkowski

*Attorney, Agent, or Firm*—Joseph L. Strabala

[57] ABSTRACT

A reedless harmonica generates control signals for a sound synthesizer which may, if desired, be situated away from the harmonica. The harmonica body has multiple air passages, each generating different musical notes through a plurality of air flow sensors which initiate electrical signals which identify each note being played and indicate changes in the amplitude of the note through transducers. In the preferred embodiment, the sensors are strain gages and circuits are provided for sequentially detecting the electrical resistivity of each gage in a repetitive scanning cycle to produce repetitive sequences of digitally coded signals. Signals produced by the harmonica can be used to control MIDI equipped sound synthesizers or for controlling other forms of electrically operated sound generating equipment.

15 Claims, 4 Drawing Sheets

FIG_1
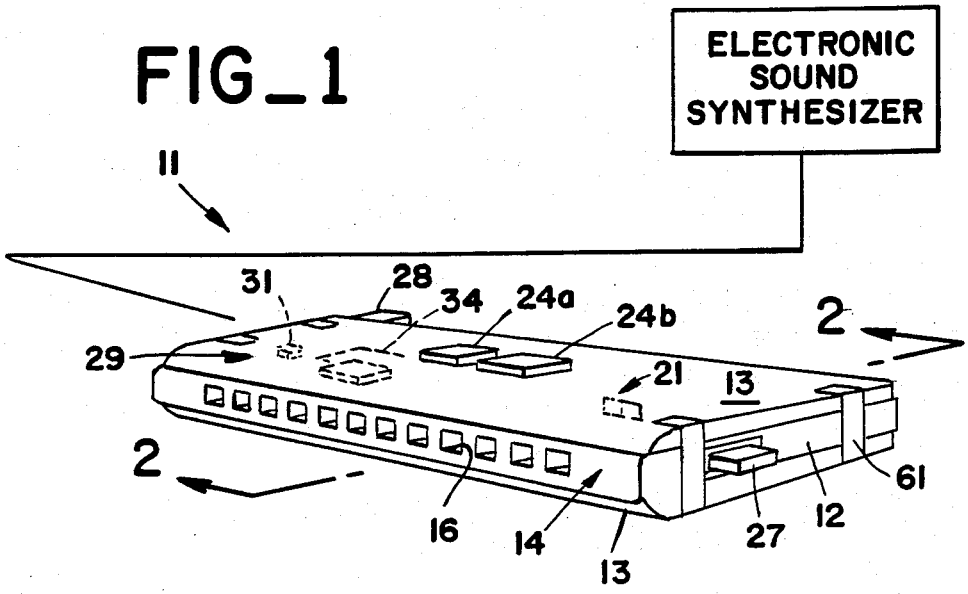
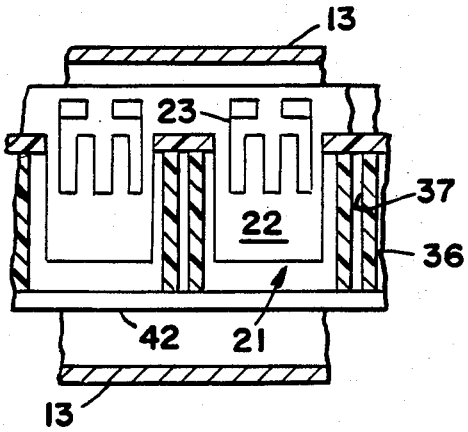
FIG_3
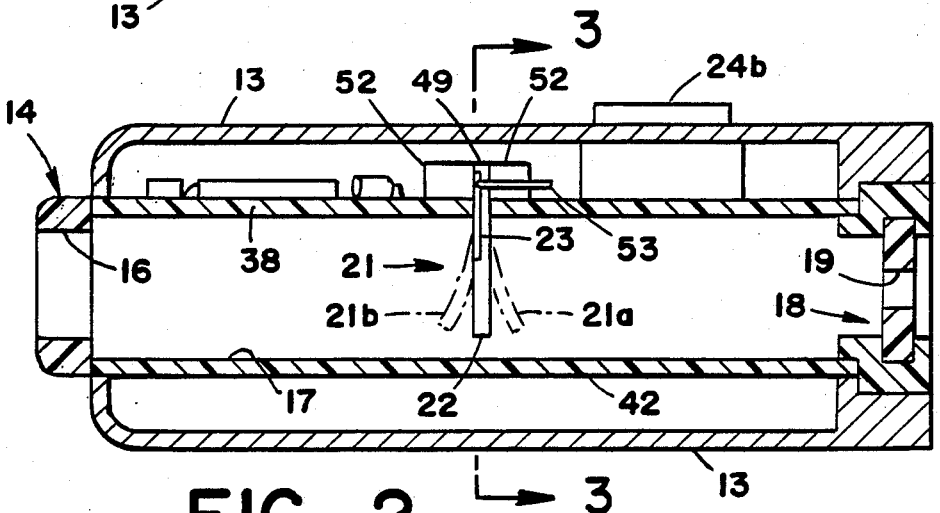
FIG_2

ELECTRONIC HARMONICA FOR CONTROLLING SOUND SYNTHESIZERS

Technical Field

This invention relates to musical instruments and more particularly to an electronic harmonica which generates electrical signals for controlling electronic sound synthesizing devices.

BACKGROUND OF THE INVENTION

The variety of sounds and range of amplitudes which can be produced with a traditional musical instrument are circumscribed by its design and by the physical limitations of the musician. Most conventional harmonicas, for example, are tuned to play a very limited range of full tones and cannot produce sharp or flat half tones. An experienced player can "bend" the notes to approximate half tones, but the result is less than desirable. The volume or amplitude of the tones produced by a conventional harmonica is also limited by the lung capacity of the musician.

Mechanically modified harmonicas have been designed to enable generation of half tones, as well as full tones. U.S. Pat. No. 2,565,100, issued Aug. 21, 1951 to J. R. Tate, discloses one example. Such instruments typically require the player learn new lip and hand movements that differ substantially from conventional techniques for playing a harmonica. These prior art instruments are also incapable of providing for other embellishments that would be desirable, such as adding chords or octave notes or changing frequencies, key, scale tempo or the like.

Prior efforts to increase the range of sound intensities obtainable from a harmonica have included installation of a microphone on the harmonica which is coupled to a loudspeaker through an electrical amplifier, as exemplified by the above identified U.S. Pat. No. 2,565,100. This results in the production of the music at the harmonica itself accompanied by a reproduction of the music at the loudspeaker location. Feedback effects, in such an arrangement, can disturb the musical performance. Such a system also does not enable any embellishments of the music produced by the harmonica, other than volume amplification.

Recent developments in electronic sound synthesizers have overcome the limitations imposed by the design of traditional musical instruments and by the physical capabilities of the musician. Such systems, in the most advanced forms, are typically controlled by a digital microprocessor be actuated with a keyboard or other input device, to produce virtually any audible tone and to provide any of a great variety of embellishments.

A harmonica construction capable of controlling such synthesizers significantly enhances the range of musical options available to harmonica players. Preferably such an instrument should have the feel of the traditional instrument and not require any substantial alteration of the conventional techniques for playing a harmonica.

Prior efforts to dispense with the reeds in the conventional harmonica and to substitute electrical elements for controlling an electrical sound producing device have not extended the capabilities of the conventional instruments.

U.S Pat. No. 2,455,032, issued Nov. 30, 1948 to A. 0. Williams, describes a construction in which the reeds are replaced with pressure sensitive switches, each of which can be operated by blowing into the harmonica and each of which causes a tone generator to produce a different one of a series of predetermined audio frequencies. The switches are on-off devices which cannot detect variations in the amplitude of notes that a musician generates.

U.S. Pat. No. 3,516,320, issued June 23, 1970 to C. A. Hillairet et al., also teaches the use of a series of air flow actuated switches to detect air flow in any of the passages of a harmonica. Actuation of any of the switches changes the output frequency of an electrical oscillator, which is coupled to an audio speaker through an amplifier, to produce the musical note which corresponds to the particular air passage. The circuit is an improvement of the Williams device in that an air velocity detector modulates the amplifier gain to vary the volume of the generated sound in response to variations in the flow rate of the player's breath. Additional controls enable the player to shift octaves and to introduce effects such as tremolo and production of semi-tones.

However, the apparatus of U.S. Pat. No. 3,516,320 does not generate separate electrical signals for each air passage that are independent of each other and which encode both activation of the passage by the musician and also the desired amplitude of the note. The note sensing switches are interlinked at the single oscillator which cannot respond accurately to simultaneous actuation of more than one such switch. The separate amplitude detecting means is a single detector which jointly monitors all air passages. These characteristics do not provide the necessary versatility for controlling a sound synthesizer.

A further characteristic of prior electronic harmonicas is undesirable mechanical complexity and fragility in the air flow sensing mechanisms. This makes such instruments costly and prone to malfunction from the effects of saliva, dust, impacts or the like.

The present invention is directed to overcoming one or more of the problems discussed above.

SUMMARY OF THE INVENTION

In one aspect, the present invention provides an electronic harmonica having a body with a plurality of air passages each corresponding to a different musical note, an electrical power source and means for enabling an electrically operated sound producing device to produce selected sequences of the musical note signals in response to passage of the player's breath through selected passages. The harmonica includes air flow sensing means for producing separate electrical signals in response to air flow through each passage and for individually varying each of the signals in response to variations of air flow rate and direction in the passage. This provides not characterizing signals which identify notes to be played and also identify the amplitude at which the note is to be played. The harmonica further includes means for transmitting each of the note characterizing signals to the sound producing transducer.

In another aspect of the present invention, an electronic harmonica for controlling a sound synthesizing device that responds to control signals identifying musical notes includes a body having a plurality of spaced apart air passages and a plurality of electrical strain gages in the body. Each of the strain gages is positioned to be flexed by air flow in a separate one of the passages. The electrical resistivity of each gage changes in response to such flexing. Means are provided for producing the control signals by detecting air flow induced changes of the resistivity of each of the strain gages.

In still another aspect, the invention provides an electronic harmonica for generating and transmitting digital control signals to a digital sound synthesizer. The harmonica body has a plurality of spaced apart air passages each corresponding to a different musical note and further components include a direct current electrical voltage supply and means for transmitting the digital control signals from the harmonica to the sound synthesizer. A plurality of strain gages are secured to the body and each gage has a flexible resilient element exposed to the air flow within a separate one of the air passages. Each strain gage has an electrical resistance which varies in response to flexing of the element and which is connected across the voltage supply. Detector means sense changes of the resistance of each strain gage and produces a plurality of analog electrical signals, each of which indicates changes in the resistance of a separate one of the strain gages. The harmonica further includes means for repetitively generating a sequence of digitally coded addresses that identify successive ones of the strain gages, an analog to digital converter, and means for reading out repetitive sequences of the analog signals from the detector means in response to receipt of successive digitally coded addresses. The resulting sequences of analog signals are directed to the analog to digital converter to produce corresponding sequences of digital signal bytes that identify the amplitudes of musical notes which are to be produced by the sound synthesizer. Means are provided for adding address code bits to each of the signal bytes to identify the musical note which each byte characterizes. The sequences of bytes, including the address code bits, are directed to the transmitting means.

The invention provides a mechanically simple and damage resistant harmonica construction which greatly expands the range of musical effects which can be created by the player of this novel instrument. The harmonica generates electrical signals which continually identify air flow rate and direction in each air passage to enable an electronic sound synthesizer to produce the desired notes at the desired amplitude and, if desired, to modify, augment and embellish the resulting music in ways that cannot be accomplished with the conventional acoustic harmonica. In the preferred form, the invention produces the electrical signals in a digital form which enables control of any of the variety of digital sound synthesizing systems or instruments that are equipped with the internationally standardized MIDI (Music Instrument Digital Interface) ports.

BRIEF DESCRIPTION OF THE DRAWINGS

FIG. 1 is a perspective view of the exterior of an electronic harmonica in accordance with the preferred embodiment of the invention.

FIG. 2 is a cross-section view of the harmonica of FIG. 1 taken along line 2—2 thereof.

FIG. 3 is a partial section view taken along line 3—3 of FIG. 2 further depicting the internal construction of the instrument.

Figure 4:
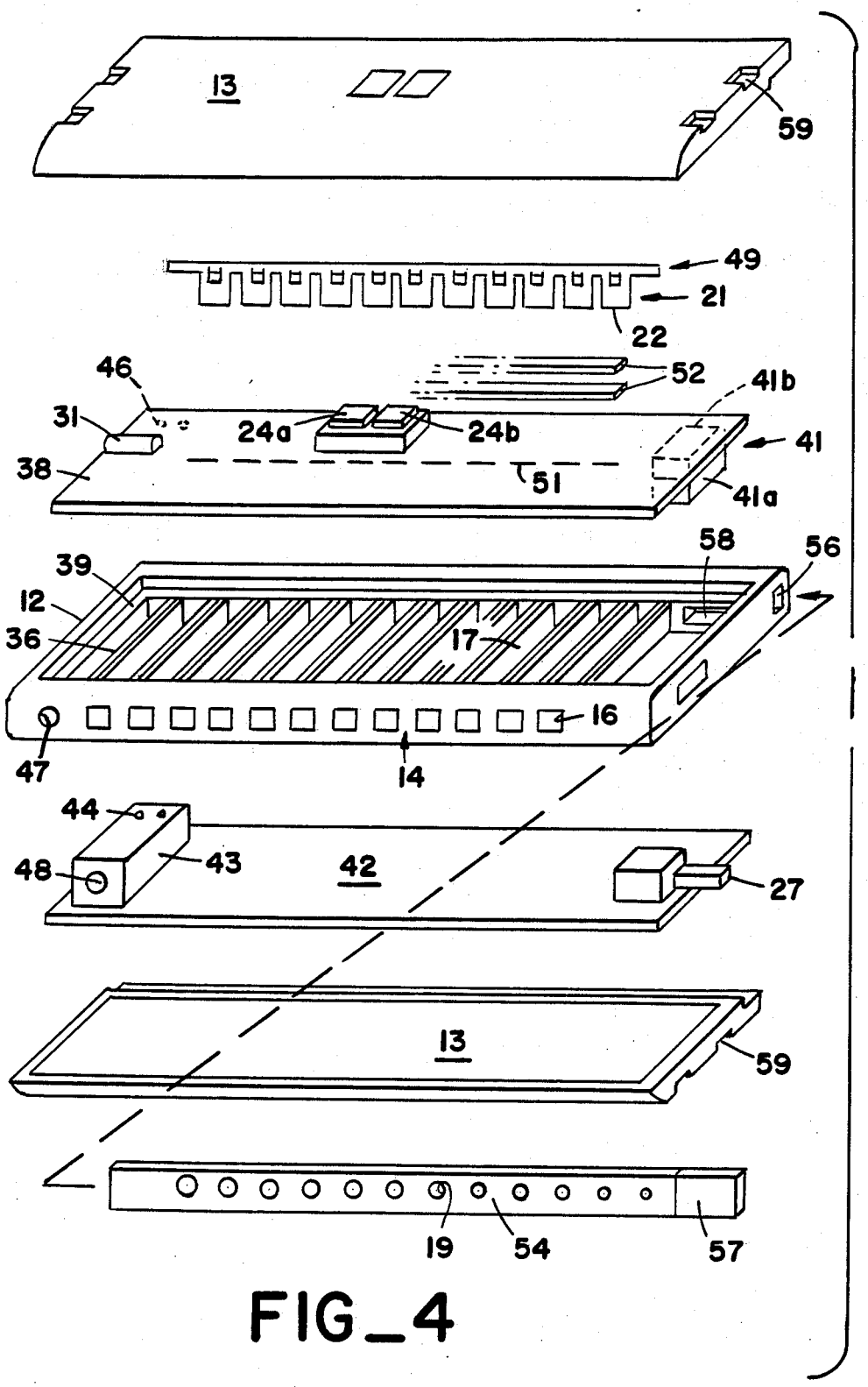
FIG. 4 is an exploded perspective view illustrating the principal components of the harmonica of the preceding figures.

FIG. an electrical circuit diagram for another embodiment of the invention which is non-digital and designed for controlling a less complex sound producing system.

DETAILED DESCRIPTION OF THE PREFERRED EMBODIMENT

Referring initially to FIG. 1 of the drawings, an electronic harmonica 11 in accordance with this embodiment of the invention may, if desired, have an external configuration closely resembling that of a conventional instrument and may be of more or less the same size. Major structural components include a flat body member 12 of rectangular outline and cover plates 13 secured against each side of the body member.

Referring to FIGS. 1 and 2 in conjunction, the forward surface of body member 12 has rounded edges to define a mouthpiece 14 and is transpierced by a row of spaced apart wind cell apertures 16 through which the musical can blow or draw air in the conventional manner. Each such aperture 16 corresponds to a different not of the musical scale as in an acoustical harmonica. This embodiment has twelve such apertures 16 to provide a chromatic harmonica although the instrument can also be constricted with other numbers of apertures. A diatonic harmonica, for example, requires only ten apertures.

With reference to FIGS. 2 and 3, each wind cell aperture 16 communicates with a separate one of a series of parallel air flow passages 17 within body member 12, which passages extend through the back of the member. An immulator flow restriction 18 at the back of each such passage 17 has an opening 19 which is smaller than the passage and is sized to create the same degree of flow resistance that a player experiences in the corresponding passage of a conventional acoustic harmonica. This resistance progressively decreases at successive ones of the passages 17 and thus the openings 19 can be of progressively greater diameter at successive ones of the passages in the direction of the left or low note end of the instrument.

One of a series of electrical strain gages 21 extends into each passage 17 in order to sense air flow, direction and also the rate of the flow as will be further discussed in connection with the electrical circuit of the harmonica 11. Strain gages 21 may be of the known form which have a flexible resilient backing 22 and a thin filmlike electrical resistor 23 adhered to the backing. Thus, flexing of the backing tensions or compresses the resistor to cause a detectable change of resistance. The strain gages 21 of this particular example are of the form which are pretensioned while being adhered to the backing 22. Consequently, flexing of the gage 21 in one direction as illustrated at **21*a* causes the electrical resistance to increase as a function of the degree of flexing and movement in the opposite direction, as illustrated at 21*b*, causes a progressive decrease in resistance. This enables sound processing equipment which may be coupled to the harmonica 11 to distinguish signals produced by blowing into the passage 17** from signals caused by drawing air through same passage. Air flow direction is sensed to provide two note signals from each passage.

Referring again to FIG. 1, the manually operated controls 24 on the harmonica 11 of this particular embodiment include two push button switches 24a and 24b that are accessible at the central region of the top cover plate 13. The switches 24 enable the player to signal the sound synthesizer 26 to select the various alterations which such systems are programmed to perform such as, for example, the introduction of chords or simulation of the sound of another musical instrument. Additional switches 24 may be provided to increase the number of such options available to the harmonica player of this novel instrument. Electrical connections to such switches will be hereinafter described.

Another push button 27 extends from the right side of harmonica 11 for selectively causing the generation of sharp or flat notes as will also be further discussed. A switch 28 for turning the harmonica 11 on and off is situated at the back of body member 12 in this example.

The harmonica 11 is further provided with transmitting means 29 for delivering signals to the remote sound synthesizer 26. Such means 29 as depicted in FIG. 1 include a signal output port of jack 31 located at the left side of body member 12 into which a multi-conductor electrical cable 32 can be plugged to conduct signals to the synthesizer 26. Other modes of signal transmission can also be used such as fiber optic transmission of coded light signals. It is advantageous in many cases, such as in stage performances, to dispense with any form of cable 32. For this purpose, the harmonica 11 may contain a small low power radio transmitter 33 having an antenna wire 34 which extends for a short distance along the left side and back of the exterior of body member 12.

FIG. 4 depicts a compact, and acceptable detailed construction for the novel harmonica 11, although it should be recognized that the components can have other configurations and also may be differently arranged.

Body member 12 in this embodiment is a rectangular frame having a series of spaced apart partitions 36 extending from front to back to define the side walls of the air passages 17. Preferably, a pair of such partitions 36 are disposed between each passage 17 and the adjacent passages, which pair of partitions are slightly spaced apart as better seen in FIG. 3. This provides a thin cushioning dead air space 37 between successive passages 17 which prevents cross-talk. Any flexing of the partition 36 at one passage 17 that may occur from changing air flow is not transferred to the adjoining passages and thus does not result in spurious signals in adjoining passages.

Referring again to FIG. 4, most of the components of the electrical circuit of the harmonica 11 are attached to or formed in a thin flat rectangular circuit board 38 which seats in a rectangular shelf 39 at the top of body member 12. Most such components, other than function switches 24a, 24b, output port 31 and a vibrato/tremolo control 41, are not depicted in FIG. 4, as the scale of the drawing does not permit such depiction and such components will be hereinafter described with reference to circuit diagrams.

Another thin flat board 42 similarly seats against the underside of body member 12 and carries the sharp/flat switch 27 and a rechargeable electrical battery 43 at opposite end locations where such components can be received in the body member at opposite ends of the series of partitions 36. Battery 43 has projecting needle-like terminals 44 that penetrate into positive and negative power supply terminal regions 46 of the circuit board 38 upon assembly of the components. Body member 12 has an opening 47 located to provide access to the recharging terminal port 48 for battery 43.

The strain gages 21 in this embodiment are linked together at the top by a continuous strip of material 49 which may be integral with the previously described backing material 22 of the individual gages. In the assembled harmonica 11, the gages 21 extend down into separate ones of the air passages 17 through a row of aligned slots 51 in the circuit board 38. Referring again to FIG. 2, the strip portion 49 of the strain gage 21 assembly is clamped between two parallel insulative linear members 52 that are secured to the top of circuit board 38. Needle-like contacts 53 are penetrated through one such member 52 to provide for electrical connections between the strain gages 21 and other circuit components.

Referring to FIGS. 2 and 4 in conjunction, the immulator flow restriction openings 19 in this example are formed in a slat-like member 54 which fits into a slot 56 that extends along the back of body member 12, successive ones of the openings being located to register with successive ones of the air flow passages 17. Slat member 54 can be replaced with another one having different sized openings 19 if it is desired to adjust the resistance to blowing or drawing which the player experiences.

Referring again to FIG. 4 in particular, insertion of the immulator slat 54 into slot 56 is followed by insertion of a small infrared light filter 57 into the end region of the slot. Filter 57 seats over an infrared light window 58 in body member 12 which faces the vibrato/tremolo control 41. One portion of control 41 is an infrared light source 41a directed at window 58 and another portion of the control is an infrared detector 41b positioned to view the window. The player's hand is situated behind the window 58 and reflects infrared from source 41a back to detector 41b. By movement of the hand, the player may vary the amount of infrared frared light that is reflected back to detector 41b and thereby vary the output signal of the detector. As will hereinafter be further described, this signal will cause the sound synthesizer to oscillate a sound frequency and thereby cause a vibrato or tremolo effect. The filter 57 prevents distortion of the desired signals by keeping ambient visible light away from detector 41b.

Covers 13, which have a shallow dished shape, fit against the top and bottom of body member 12 to enclose the internal components of the harmonica 11 and to define a hand grip. Covers 13 have a pair of shallow notches 59 at each end for, with reference to FIG. 1, receiving the ends of U-shaped spring tensioned clips 61 which secure the assembled components together. The components may also be held together by other fasteners such as screws or by adhesives if the instrument is not intended to be disassemble.

Figure 5:
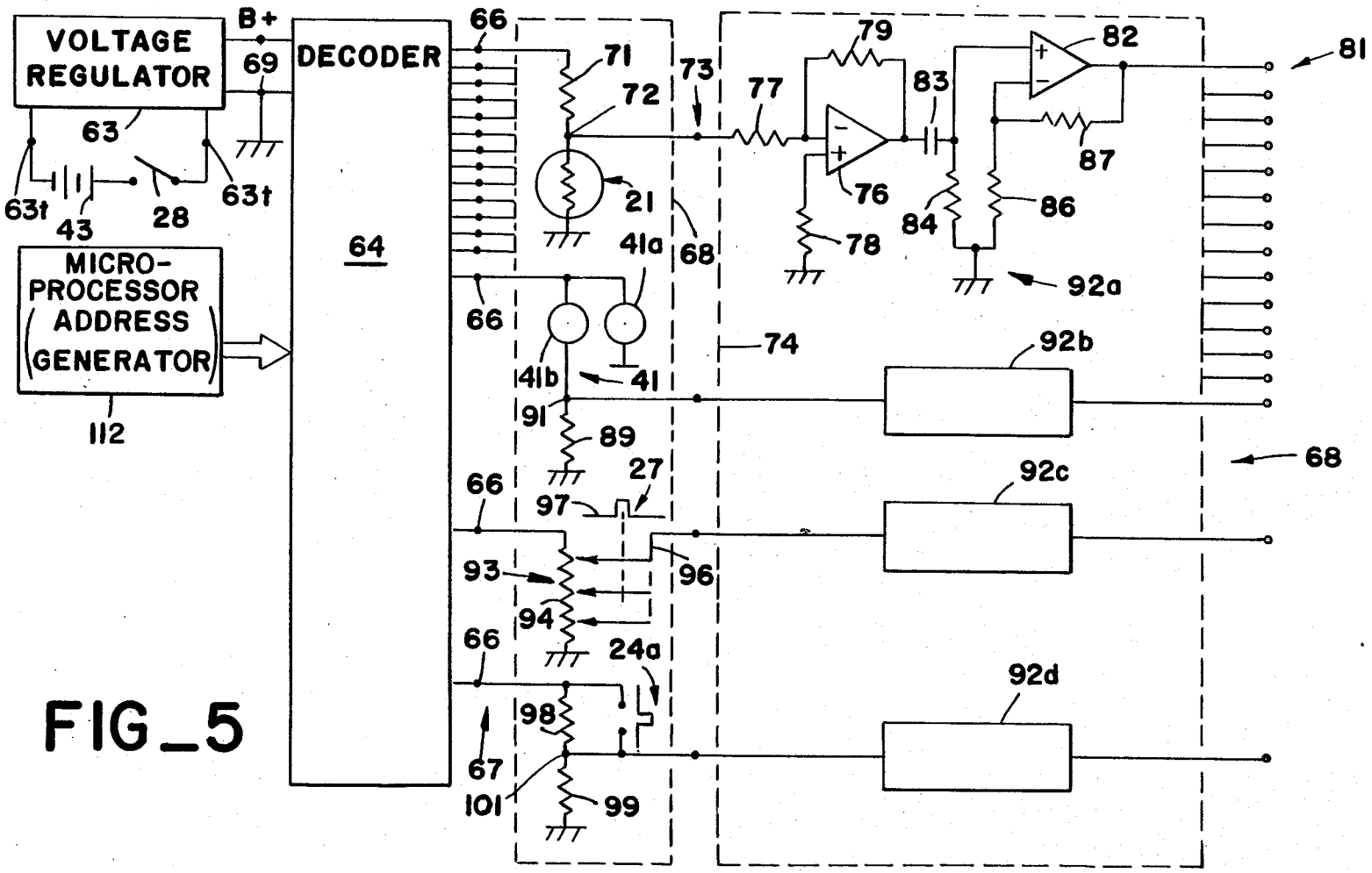
FIG. 5 is a circuit diagram depicting certain electrical components of the preferred embodiment.

Referring now to FIG. 5, electrical components of the harmonica receive D.C. operating voltage from the positive terminal B+ of a voltage regulator 63 which also has another terminal 69 defining a common conductor or chassis ground. The battery 43 and on-off switch 28 are connected across the voltage regulator 63 input terminals 63t in series relationship with each other.

The strain gages 21, the function control switches such as 24a, the sharp/flat switch 27 and the vibrato/tremolo control 41 are each in a separate one of sixteen signal channels 67 through a signal generating circuit 68. Channels 67 sequentially receive a momentary input voltage from a digital address decoder 64 which will hereinafter be further discussed. The sequence of momentary applications of B+ voltage to the input terminals 66 of channels 67 is continually repeated, while the instrument is in operation, preferably at a high repetition rate or frequency which is 20 HZ in this particular example. High frequency scanning of the channels 67 produces higher quality sound as air flow changes are detected more quickly and in smaller increments than is possible at lower frequencies.

Each strain gage 21, of which only a single one is depicted in FIG. 5, is connected between the input terminal 66 of a separate channel 67 and chassis ground in series relationship with a fixed resistor 71. Thus each such gage 21 and its associated resistor 71 functions as a voltage divider and the voltage at the junction 72 between the gage and resistor, during successive energizations of the channel 67, varies in response to the changes of resistivity of the gage that are caused by variations in air flow rate through the corresponding one of the harmonica passages as previously described. The varying voltage pulses from each such circuit junction 72 are transmitted to a separate input terminal 73 of a signal sensing circuit 74.

Within the signal sensing circuit 74, each input terminal 73 is connected to the negative or inverting input of a separate one of a series of voltage amplifiers 76 through an input resistor 77, the positive or noninverting input of the amp ifier being connected to ground through another resistor 78. A feedback resistor 79 fixes the gain of the amplifier 76 in the known manner.

Output pulses from amplifier 76 are transmitted to a separate one of a series of output terminals 81 of the sensing circuit 74 through one of a series of buffer amplifiers 82. In particular, the output of amplifier 76 is coupled to the noninverting input of buffer amplifier 82 through a capacitor 83 which input is also connected to ground through a resistor 84. The inverting input of the buffer amplifier 82 is connected to chassis ground through another resistor 86 and to the output of the amplifier through a feedback resistor 87. Thus, each buffer amplifier 82 of the sending circuit 74 transmits a voltage pulse to the associated out-terminal 81 each time decoder 64 energizes the associated signal channel 67, the amplitude of the pulse being indicative of the momentary rate of air flow through the corresponding one of the harmonica air passages at the time of the strobe.

To generate the vibrato/tremolo signal within the signal generating circuit 68, the infrared light detector **41*b* is a photodiode connected between a decoder terminal 66 and chassis ground in series with a voltage dropping resistor 89. The junction 91 between photodiode detector 41*b* and resistor 89 is coupled to the associated separate one of the output terminals 81 in sensing circuit 74 through an amplifier circuit 92*b* which may be similar to the circuit 92*a* described above with reference to the strain gage 21 signal channel. The infrared light source 41*a*, which may be a light emitting diode, is connected between the same input terminal 66** and chassis ground.

Thus the diodes **41*a* and 41*b* are both momentarily energized each time that decoder 64 applies a momentary voltage to the associated input terminal 66. The amount of infrared light from diode 41*a* that is received by diode 41*b* is dependent on the harmonica player's hand movements in the manner previously described. The diode detector 41*b* and resistor 89 are in effect a voltage divider. Consequently, as the resistance of diode 41*b* varies in response to variations in the amount of infrared which it receives, the magnitude of successive voltage pulses at junction 91 and at the associated output terminal 81 is varied in response to the player's hand movements. Oscillation of the player's hand causes a similar oscillation of the amplitude of successive voltage pulses at the terminal 81**.

Signals identifying the setting of the sharp/flat selector switch 27 are generated in circuit 68 by a linear potentiometer 93 having a resistive element 94 connected between the associated input terminal 66 and chassis ground and having an adjustable tap 96 which is shiftable to any of three positions along the resistive element by depression or release of the actuator button 97.

Tap 96 is coupled to another of the sensing circuit output terminals 81 by another amplifier circuit **92*c* similar to the previously described amplifier circuit 92*a*. Thus, upon each energization of the potentiometer 93 by decoder 64, a voltage pulse appears at the terminal 81 that has one of three different magnitudes as determined by the harmonica player. The highest magnitude voltage, produced when switch 27 is at its normal position, signals that natural notes are to be played. Partial depression of the actuator 97** to the intermediate position signals for sharp notes and full depression indicates that flat notes are to be synthesized.

In order to generate signals indicating the setting of function selector switch **24*a*, a pair of fixed voltage divider resistors 98 and 99 are connected in series between the associated input terminal 66 and chassis ground. The normally open function selector switch 24*a* bridges the one of the resistors 98 that is directly connected to terminal 66. The junction 101 between resistors 98 and 99 is coupled to another output terminal 88 of sensing circuit 74 through still another amplifier circuit 92*d*** of the type previously described.

Thus repetitive voltages pulses having a first amplitude appear at the associated one of the sensing circuit output terminals 81 when switch **24*a* is in the normal open condition and indicate that the function controlled by the switch is not wanted. Closing of the switch 24*a* by the harmonica player causes higher voltage pulses to appear at the terminal 81** to signal the sound synthesizer that the function is to be implemented.

The circuit 68 has been described in detail with respect to only one of the strain gage 21 channels and only one of the function selector switch **24*a*** channels. It should be understood that the circuit detail for each of the other strain gages and the other function selector switch may be of similar configuration.

It may be noted, with reference jointly to FIGS. 2 and 5, that voltage pulses of a predetermined amplitude will appear at sensing circuit output terminals 81 when there is no air flow in the harmonica passages 17 and the strain gages 21 are in the unflexed state. Flexing of the strain gages 21 in one direction **21*a* causes the pulse amplitudes to rise from this normal value by an amount dependent on the degree of flexing and thus the rate of air flow. Flexing of the gages 21 in the opposite direction 21*b* causes a lowering of pulse amplitudes to a degree dependent on the magnitude of the flexing. The normal pulse voltage that is produced under conditions of no air flow is interpreted by the signal utilizing system as calling for an off or no sound signal. Increasing or decreasing voltages from any of the strain gage channels 67 are interpreted as calling for synthesizing of the particular musical note to which that channel corresponds at an amplitude or volume dependent on the amount of the voltage increase or decrease. The fact that the pulse amplitudes may either increase or decrease from the no air flow value, depending on direction of air flow, enables definition between notes produced by blowing into the harmonica 11** and notes producing by drawing or sucking on the harmonica.

The circuit described above causes momentary voltage pulses to appear sequentially at the sixteen output terminals 81 of the sensing circuit 74 in a repetitive cycle, each pulse being an analog signal which characterizes what the harmonica player desires at that instant with respect to a particular musical note or with respect to a particular control function. These signals may be used in any of various way for controlling known forms of sound synthesizing apparatus.

Figure 6:
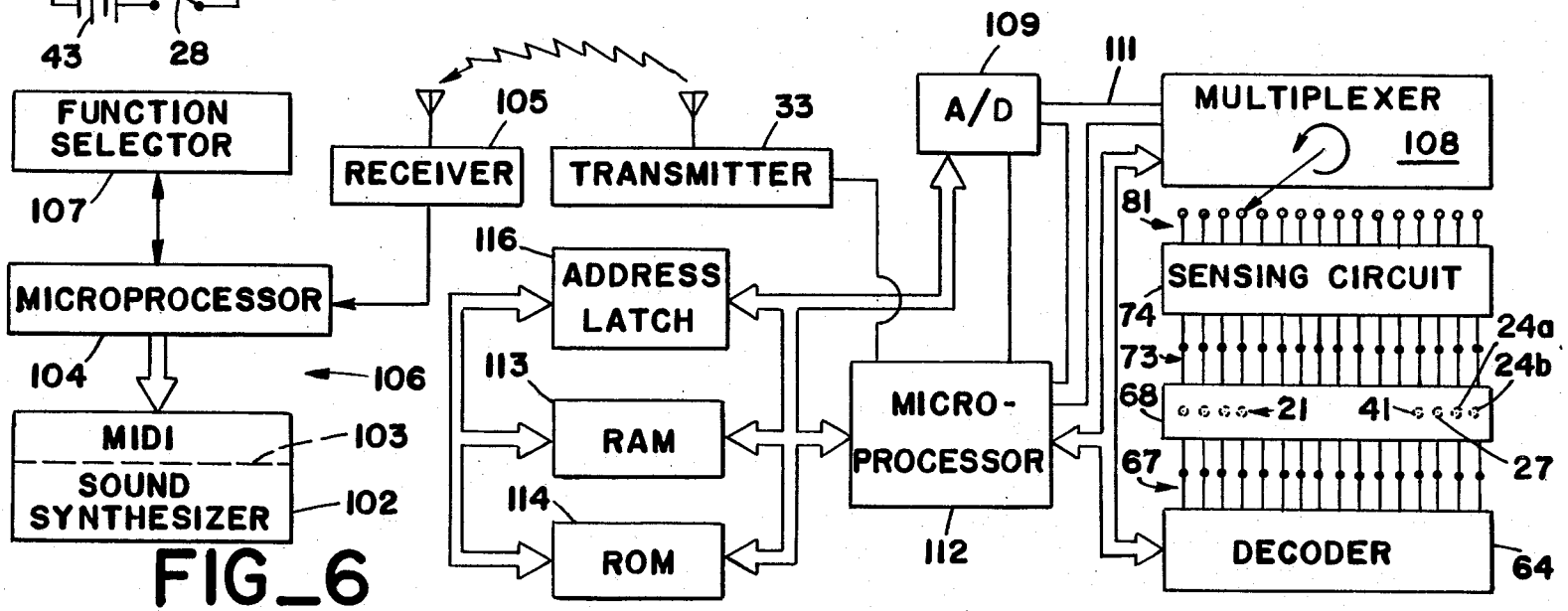
FIG. 6 is a circuit diagram showing further components of the circuit which enable coupling of the harmonica to a MIDI equipped digital sound synthesizer.

For example, with reference to FIG. 6, the analog signals from sensing circuit output terminals 81 may be digitized and transmitted to one or more digital sound synthesizers 102 of the type having a MIDI signal interface 103 and which are typically controlled by a computer or microprocessor 104. The construction and operation of such sound generating equipment 106 are well understood in the art and widely employed in apparatus ranging from electronic keyboards sold for amateur use to complex, costly installations for professional synthesizing of music or other acoustical effects. Typically such apparatus includes a function selector console 107 by which an operator can condition the microprocessor 104 to augment to modify the original notes produced by the musician in any of a variety of ways, including, among many other examples, addition of chords, conversion of musical key, substitution of sharp or flat notes or simulation of the sound of some instrument other than the one at which the signals actually originate.

The signals from the outputs 81 of sensing circuit 74 can be transmitted to the receiving equipment 106 over sixteen separate lines or radio channels but this complication can be avoided by serializing the data for transmission by a single channel. For this purpose, a multiplexer 108 reads out the voltages from each terminal 81 in sequence and delivers corresponding signal voltages to an analog to digital signal converter 109 in serial form through a single signal channel 111. Multiplexer 108 receives the same address signals as decoder 64 and thus repetitively reads out the sequence of signals in synchronism with the energizing of the channels 67 by decoder 64.

The repetitive sequence of digital address codes for cycling decoder 64 and multiplexer 108 and clock signals for repetitively enabling such components can be generated by circuits of the type specifically designed for the purpose but it is advantageous to use a microprocessor 112, coupled to a random access memory 113, read only memory 114 and address latch 116, for these purposes. Programming of a microprocessor 112 to repetitively read out a series of stored digital addressed from memory 114 and to generate cyclical enabling signals for peripheral components 64, 108, 109 and 112 is a relatively simple operation well understood in the art.

Analog to digital converter 109 converts each successive signal voltage received on channel 111 to a multibit digital byte or word that identifies the magnitude of the voltage and thus the momentary amplitude of the musical note that the harmonica player desires. Converter 109 produces ten bit digital words in this example in order to provide 60 dB of dynamic range which exceeds that of an acoustic harmonica.

To provide for transmission of the data to the remote receiving equipment 106 over a single channel, the digital words produced by converter 109 are serialized prior to delivery to the transmitter 33. While a separate parallel to serial signal converter can be used for the purpose, this is preferably done by the microprocessor 112 which also transmits the address bits with each such word to identify the note which the word characterizes. Similarly, a separate serial to parallel converter may be provided between the received 105 and sound synthesizer 102 to reparallelize the successive signal bytes but this is more conveniently done by the receiver microprocessor 104.

The signal generating harmonica is not limited to production of digital signals for transmission to a MIDI equipped sound synthesizing device 106 of the above described kind and can be adapted to control a variety of other sound generating devices. For example, with reference to FIG. 7, the harmonica can be used to selectively actuate any of a series of electrical oscillator circuits 117 of the type that generate an audio frequency output in response to a control signal voltage and at an amplitude that is proportional to the magnitude of the control signal voltage. Each such oscillator 117 may have a different frequency corresponding to the frequency of a different musical note. Each such oscillator 117 may be coupled to an audio speaker 118 through a separate one of a series of buffer amplifiers 119. Thus the speaker 118 produces sounds having audio frequencies corresponding to the electrical frequency received from any of the oscillators 117.

Modifications of the harmonica circuits for this purpose include connecting the battery 43 and on-off switch 28 to a D.C. power supply **63*a* of the bipolar type which has both positive and negative output terminals B+ and B−. A pair of equal resistances 121 are connected in series across the B+ and B− terminals and the junction between the two resistances define the chassis ground for the circuit. Thus, the positive and negative voltages provided by the power supply 63*a*** have equal magnitudes relative to ground but are of opposite polarities.

Each strain gage 21 is connected across the power supply terminals B+, B− in series with one of a group of resistors 122 each of which has a resistance equal to that of the strain gage when it is in the relaxed or unflexed condition. Thus, the junctions 123 between the resistors 122 and strain gages 21 are at ground potential when the gages are in the unflexed state and no output signal is present. As each strain gage 21 and the associated resistor 122 is in effect a voltage divider, an increase of the resistance of the gage caused by flexing results in a positive voltage at junction 123 that is proportional to the amount of flexing. Similarly, a decrease of the strain gage resistance caused by flexing in the opposite direction produces a proportionate negative voltage at junction 123.

Figure 7:
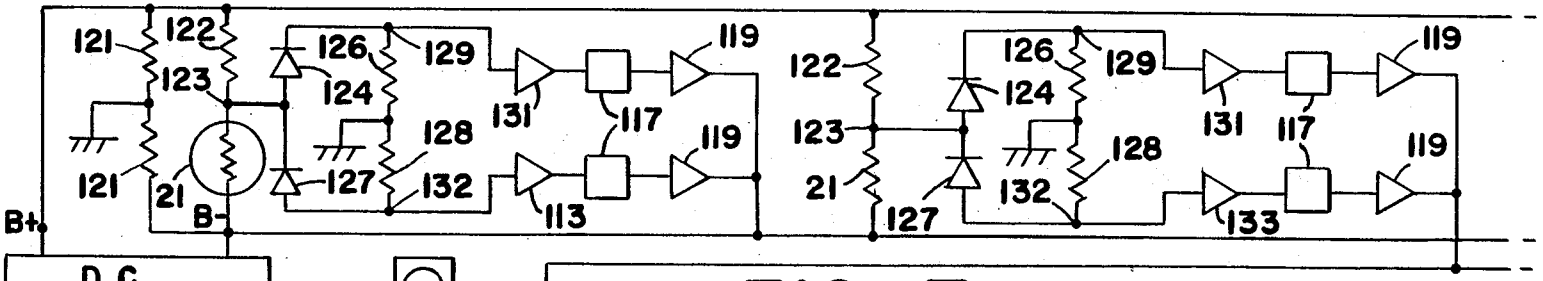

Each junction 123 is connected to chassis ground through a first diode 124 and resistor 126 and also through a second diode 127 and resistor 128, the two diodes being oppositely oriented to conduct positive and negative voltages respectively. The junction 129 between first diode 124 and resistor 126 is coupled to the control input of a first of the oscillators 117 through a D.C. amplifier 131 and the junction 132 between second diode 127 and resistor 128 is coupled to another of the oscillators 117 through a separate D.C. amplifier 133. Amplifier 133 is a polarity inverting amplifier as the oscillators 117 of this embodiment all respond to control voltages of the same polarity. While the connections to only two of the strain gages 21 are depicted in FIG. 7, each of the other strain gages in the harmonica is similarly connected to a separate pair of the oscillators 117.

Thus blowing into any selected air passage of the harmonica actuates a corresponding one of the oscillators 117 resulting in generation of the corresponding musical note at speaker 118. Sucking or drawing air through the same passage actuates a different oscillator 117 to produce a different musical note. If it is desired that the system produce the same musical note in response to air flow in a particular harmonica passage without regard to the direction of flow, the D.C. amplifiers 131 and 133 may be coupled to the same oscillator 117.

While the invention has been disclosed with respect to certain particular embodiments for purposes of example, many variations and modifications are possible and it is not intended to limit the invention except as defined in the following claims.

What is claimed:

1. An electronic harmonica having a body with a plurality of air passages each for a corresponding different musical note, an electrical power source, and means for enabling an electrically operated sound producing device to produce selected sequences of said musical notes in response to passage of the player's breath through selected ones of said passages, the improvement comprising:

air flow sensing means for producing separate electrical signals in response to air flow through each of said passages and for individually varying each of said signals in response to variations of the rate of air flow and direction in the passage to provide note characterizing signals which identify notes to be played and also identify the amplitude at which the note is to be played, said air flow sensing means includes a plurality of strain gages each having a flexible resilient element exposed to the air flow within a separate one of said passages and having an electrical resistance which varies in response to changes in the degree of and direction of flexing of its resilient element, and wherein said air flow sensing means produces said signals by detecting changes of said electrical resistance at each of said strain gages, and transmitting means for transmitting each of said note characterizing signals to said sound producing device.

2. The apparatus of claim 1 wherein said air flow sensing means includes a plurality of air flow sensors each being exposed to the air flow within a separate one of said air passages and each having an output conductor for which a separate one of said note characterizing signals is provided, and wherein said air flow sensing means repetitively cycles through a sequential readout of said signals from successive ones of said output conductors and said transmitting means transmits said note characterizing signals to said sound producing device in corresponding repetitive sequences of said signals.

3. The apparatus of claim 1 wherein said air flow sensing means produces said signals in the form of variable D.C. voltages, further including an analog to digital signal converter coupled between said air flow sensing means and said signal transmitting means.

4. The apparatus of claim 3 further including a parallel to serial signal converter coupled between said analog to digital converter and said transmitting means.

5. The apparatus of claim 4 wherein said sound producing device is an electronic sound synthesizer of the type which responds to digital signal bytes in parallel form, said apparatus further including said sound producing device, receiver means for receiving said signals from said transmitting means, and a serial to parallel signal conversion device coupled between said receiver means and said sound producing device.

6. The apparatus of claim 1 further including means for digitizing said signals that are produced by said air flow sensing means into sequences of signal bytes, and address encoding means for adding additional signal bits to said signal bytes which additional signal bits identify the particular air passage at which the particular signal originated.

7. The apparatus of claim 1 further including at least one manually operable control on said harmonica for selectively causing said sound producing device to perform a selected alteration in the music produced hereby, said control having means for generating an auxiliary function signal in response to manual operation thereof, and wherein said transmitting means transmits said auxiliary function signal to said sound producing device together with said note characterizing signals.

8. The apparatus of claim 1 wherein said air passages extend in spaced apart parallel relationship within said body and wherein said body further includes a pair of parallel internal wall members between each air passage and the adjacent air passage which wall members block air flow exchange between passages, the wall members of each of said pairs being spaced apart to define dead air chambers between successive ones of said air passages.

9. The apparatus of claim 1 further including means for establishing a flow restriction in each of said air passages which flow restrictions are of progressively changing size in successive ones of said air passages.

10. An electronic harmonica having a body with a plurality of air passages each for a corresponding different musical note, an electrical power source, and means for enabling an electrically operated sound producing device to produce selected sequences of said musical notes in response to passage of the player's breath through selected ones of said passages, the improvement comprising:

air flow sensing means for producing separate electrical signals in response to air flow through each of said passages and for individually varying each of said signals in response to variations of the rate of air flow and direction in the passage to provide note characterizing signals which identify notes to be played and also identify the amplitude at which the note is to be generated, said air flow sensing means including a plurality of strain gages each having a flexible resilient element positioned to be flexed by air flow through a separate one of said air passages and each having an electrical resistance which varies in response to said flexing, and each having a separate note signal output terminal, a plurality of voltage dividing resistors, each being connected in series with a separate one of said strain gage resistances through said output terminal of the strain gage, means for applying a predetermined voltage across each series connected voltage dividing resistor and electrical resistance, a plurality of note signal detector amplifiers each having an input connected to a separate one of said strain gage signal output terminals to detect changes in the voltage across the associated one of said electrical resistances, and multiplexing means for sequentially and repetitively transmitting an output signal from each of said amplifiers to said transmitting means.

11. The apparatus of claim 10 further including address generating means for repetitively generating a sequence of address codes each of which identifies a separate one of said air passages and wherein said means for applying a predetermined voltage across each series connected voltage dividing resistor and electrical resistance applies said voltage to successive ones thereof in sequence in response to said sequence of address codes and wherein said multiplexing means sequentially couples each of said amplifiers to said transmitting means in corresponding response to said sequence of address codes, said apparatus further including means for causing transmission of the corresponding one of said address codes together with each of said note signals.

12. The apparatus of claim 11 wherein said address generating means generates said address codes in digital signal form and wherein said means for applying a predetermined voltage across each series connected voltage dividing resistor and electrical resistance includes a digital decoder receiving said address codes and having a plurality of outputs which are sequentially activated in response thereto and which are connected to separate successive ones of said series connected voltage dividing resistors and electrical resistances, said apparatus further including analog to digital signal converter means for converting said note signals to digital form for joint transmission with said address codes.

13. The apparatus of claim 12 wherein said address generating means and said means for causing transmission of the corresponding one of said address codes together with each of said note signals are components of a digital microprocessor contained within said harmonica.

14. An electronic harmonica for controlling a sound synthesizing device that responds to control signals identifying musical notes which are to by synthesized, comprising:

a harmonica body having a plurality of spaced apart air passages, a plurality of electrical strain gages in said body, each being positioned to be flexed by air flow in a separate one of said air passages and each having an electrical resistivity which changes in response to said flexing, and means for producing said control signals by detecting changes of said resistivity of each of said strain gages that are produced by air flow variations in said air passages.

15. An electronic harmonica for generating and transmitting digital control signals to a digital sound synthesizer comprising:

a harmonica body having a plurality of spaced apart air passages each for a corresponding different musical note, a direct current electrical voltage supply within said body, signal transmitting means for transmitting said digital control signals from said harmonica to said sound synthesizer, a plurality of strain gages secured to said body each having a flexible resilient element exposed to air flow within a separate one of said air passages and each having an electrical resistance which varies in response to flexing of said element, said electrical resistance being connected across said voltage supply, detector means for sensing changes of said electrical resistance of each of said strain gages and for producing a plurality of analog electrical signals each of which is indicative of changes of the electrical resistance of a separate one of said strain gages, means for repetitively generating a sequence of digitally coded addresses that identify successive ones of said strain gages, an analog to digital signal converter, means for reading out repetitive sequences of said analog electrical signals from said detector means in response to receipt of successive ones of said digitally coded addresses and for directing the resulting sequences of analog signals to said analog to digital signal converter to produce corresponding sequences of digital signal bytes that identify the amplitudes of different musical notes which are to be produced by said sound synthesizer, means for adding address code bits to each of said signal bytes to identify the musical note which each byte characterizes, and means for directing said sequencies of signal bytes including said address code bits to said transmitting means.

* * * * *